US006782365B1

(12) United States Patent
Case

(10) Patent No.: US 6,782,365 B1
(45) **Date of Patent: *Aug. 24, 2004**

(54) GRAPHIC INTERFACE SYSTEM AND PRODUCT FOR EDITING ENCODED AUDIO DATA

(75) Inventor: Eliot M. Case, Denver, CO (US)

(73) Assignee: Qwest Communications International Inc., Denver, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/771,469

(22) Filed: Dec. 20, 1996

(51) Int. Cl.[7] ..... G10L 21/00
(52) U.S. Cl. ..... 704/278
(58) Field of Search ..... 704/208, 278, 704/233, 500, 501, 503, 504; 381/62, 119, 118

(56) References Cited

U.S. PATENT DOCUMENTS

| | | | |
|---|---|---|---|
| 4,061,875 | A | 12/1977 | Freifeld et al. |
| 4,099,035 | A | 7/1978 | Yanick |
| 4,118,604 | A | 10/1978 | Yanick |
| 4,156,116 | A | 5/1979 | Yanick |
| 4,509,186 | A | 4/1985 | Omura et al. |
| 4,536,886 | A | 8/1985 | Papamichalis et al. |
| 4,703,480 | A | 10/1987 | Westall et al. |

(List continued on next page.)

FOREIGN PATENT DOCUMENTS

| | | | |
|---|---|---|---|
| EP | 0446037 | A2 | 9/1991 |
| EP | 0446037 | A3 | 9/1991 |
| EP | 0607989 | A3 | 7/1994 |
| EP | 0607989 | A2 | 7/1994 |
| WO | WO91/06945 | | 5/1991 |
| WO | WO94/25959 | | 11/1994 |

OTHER PUBLICATIONS

Brandenburg et al, ISO–MPEG–1 Audio: A Generic Standard for Coding of High Quality Digital Audio,J. Audio Eng. Soc, vol. 42 No. 10, Oct. 1994.*

"NuWave User's Manual", Antex Digital Audio, 310–532–3092, Aug. 21, 1996.*

Parsons, Voice and Speech Processing, McGraw Hill, p 100–102, 1987.*

Broadhead, "Direct Manipulation of MPEG Compressed Digital Audio" ACM Multimedia 95, Nov. 9, 1995.*

Cool Edit, Syntrillium Software, 1995.*

James L. Flanagan, Speech Analysis, Synthesis and Perception, 1965, NY Academic Press Inc., Springer–Verlag, pp. 141–145.*

New Digital Hearing Aids Perk Up Investors' Ears, St. Louis Post–Dispatch, Sep. 27, 1995.

Jean–Pierre Renard, Ph.D., B.B.A., High Fidelity Audio Coding, pp. 87–97.

*Primary Examiner*—David D. Knepper
(74) *Attorney, Agent, or Firm*—Brooks Kushman P.C.

(57) ABSTRACT

A graphic interface system and product are provided for editing an encoded audio signal. The system includes a receiver for receiving an encoded audio signal having multiple frequency subbands, as well as control logic operative to generate a spectral graph of the encoded audio signal, the spectral graph including an amplitude of each frequency subband as a function of time, and to mark a selectable edit point of the encoded audio signal. The system also includes a display unit for displaying the spectral graph including the edit point marked, and an input device for selecting the edit point. The product includes a storage medium having computer readable programmed instructions recorded thereon.

15 Claims, 3 Drawing Sheets

U.S. PATENT DOCUMENTS 4,718,097 A * 1/1988 Uenoyama ..... 704/210
4,813,076 A 3/1989 Miller
4,820,059 A 4/1989 Miller et al.
4,939,782 A * 7/1990 Gambacurta, Jr. et al. .. 381/103
4,969,192 A 11/1990 Chen et al.
4,975,958 A 12/1990 Hanada et al.
5,033,090 A 7/1991 Weinrich
5,040,217 A 8/1991 Brandenburg et al.
5,140,638 A 8/1992 Moulsley et al.
5,199,076 A 3/1993 Taniguchi et al.
5,201,006 A 4/1993 Weinrich
5,226,085 A 7/1993 Di Francesco
5,227,788 A 7/1993 Johnston et al.
5,233,660 A 8/1993 Chen
5,235,669 A 8/1993 Ordentlich et al.
5,255,343 A 10/1993 Su
5,285,498 A 2/1994 Johnston
5,293,449 A 3/1994 Tzeng
5,293,633 A 3/1994 Robbins
5,301,019 A 4/1994 Citta
5,301,205 A 4/1994 Tsutsui et al.
5,329,613 A 7/1994 Brase et al.
5,341,457 A 8/1994 Hall, II et al.
5,353,375 A 10/1994 Goto et al.
5,404,377 A 4/1995 Moses
5,467,139 A 11/1995 Lankford
5,473,631 A 12/1995 Moses
5,488,665 A 1/1996 Johnston et al.
5,500,673 A 3/1996 Zhou
5,509,017 A 4/1996 Brandenburg et al.
5,511,093 A 4/1996 Edler et al.
5,512,939 A 4/1996 Zhou
5,515,395 A 5/1996 Tsutsui
5,544,248 A * 8/1996 Date ..... 365/184
5,848,164 A * 12/1998 Levine ..... 381/61

* cited by examiner

GRAPHIC INTERFACE SYSTEM AND PRODUCT FOR EDITING ENCODED AUDIO DATA

Cross-Reference To Related Applications

This application is related to U.S. patent application Ser. No. 08/771,790 entitled "Method, System And Product For Lossless Encoding Of Digital Audio Data"; Ser. No. 08/771,462 entitled "Method, System And Product For Modifying The Dynamic Range Of Encoded Audio Signals"; Ser. No. 08/771,792 entitled "Method, System And Product For Modifying Transmission And Playback Of Encoded Audio Data"; Ser. No. 08/771,512 entitled "Method, System And Product For Harmonic Enhancement Of Encoded Audio Signals"; Ser. No. 08/769,911 entitled "Method, System And Product For Multiband Compression Of Encoded Audio Signals"; Ser. No. 08/777,724 entitled "Method, System And Product For Mixing Of Encoded Audio Signals"; Ser. No. 08/769,732 entitled "Method, System And Product For Using Encoded Audio Signals In A Speech Recognition System"; Ser. No. 08/772, 591 entitled "Method, System And Product For Synthesizing Sound Using Encoded Audio Signals"; and Ser. No. 08/769,731 entitled "Method, System And Product For Concatenation of Sound And Voice Files Using Encoded Audio Data", all of which were filed on the same date and assigned to the same assignee as the present application.

TECHNICAL FIELD

This invention relates to a graphic interface system and product for editing encoded audio data.

BACKGROUND ART

To more efficiently transmit digital audio data on low bandwidth data networks, or to store larger amounts of digital audio data in a small data space, various data compression or encoding systems and techniques have been developed. Many such encoded audio systems use as a main element in data reduction the concept of not transmitting, or otherwise not storing portions of the audio that might not be perceived by an end user. As a result, such systems are referred to as perceptually encoded or "lossy" audio systems.

However, as a result of such data elimination, perceptually encoded audio systems are not considered "audiophile" quality, and suffer from processing limitations. To overcome such deficiencies, a method, system and product have been developed to encode digital audio signals in a loss-less fashion, which is more properly referred to as "component audio" rather than perceptual encoding, since all portions or components of the digital audio signal are retained. Such a method, system and product are described in detail in U.S. patent application Ser. No. 08/771,790 entitled "Method, System And Product For Lossless Encoding Of Digital Audio Data", which was filed on the same date and assigned to the same assignee as the present application, and is hereby incorporated by reference.

While waveform editors exist for linear encoded digital audio signals, no Graphical User Interface (GUI) tools exist for directly editing encoded audio data, such as perceptually encoded audio data or component audio data. As a result, encoded audio data must first be decoded to conventional high resolution audio for editing, and then the edited audio must be re-encoded.

Thus, there exists a need for a graphic interface system and product for editing encoded audio signals such as perceptually encoded and component audio signals. Such a system and product would allow precision editing of otherwise un-editable data to facilitate direct creation of extremely data compressed and high quality audio for use in any interactive service, CD-ROM, computer, multimedia system, or numerous other applications such as entertainment.

SUMMARY OF THE INVENTION

Accordingly, it is the principle object of the present invention to provide a graphic interface system and product for editing an encoded audio signals such as perceptually encoded and component audio signals.

According to the present invention, then, a graphic interface system is provided for editing an encoded audio signal. The system comprises a receiver for receiving an encoded audio signal having a plurality of frequency subbands, as well as control logic operative to generate a spectral graph of the encoded audio signal, the spectral graph including an amplitude of each frequency subband as a function of time, and to mark at least one selectable edit point of the encoded audio signal. The system further comprises a display unit for displaying the spectral graph including the at least one edit point marked, and an input device for selecting the at least one edit point.

A graphic interface product for editing an encoded audio signal is also provided. The product is for use with a receiver for receiving an encoded audio signal having a plurality of frequency subbands, a display unit and an input device. The product comprises a storage medium having computer readable programmed instructions recorded thereon, the instructions operative to generate a spectral graph of the encoded audio signal, the spectral graph including an amplitude of each frequency subband as a function of time, and to mark at least one selectable edit point of the encoded audio signal. The a display unit is provided for displaying the spectral graph including the at least one edit point marked, and the input device is provided for selecting the at least one edit point.

These and other objects, features and advantages will be readily apparent upon consideration of the following detailed description in conjunction with the accompanying drawings.

BEST MODE FOR CARRYING OUT THE INVENTION

In general, the present invention is designed to provide a graphic editing system for encoded audio data, particularly perceptually encoded audio data, using amplitude, perceptually contoured amplitude, waveform and spectral displays. The present invention also includes added functions of sound and speech recognition to automate or semi-automate editing.

Figure 1:
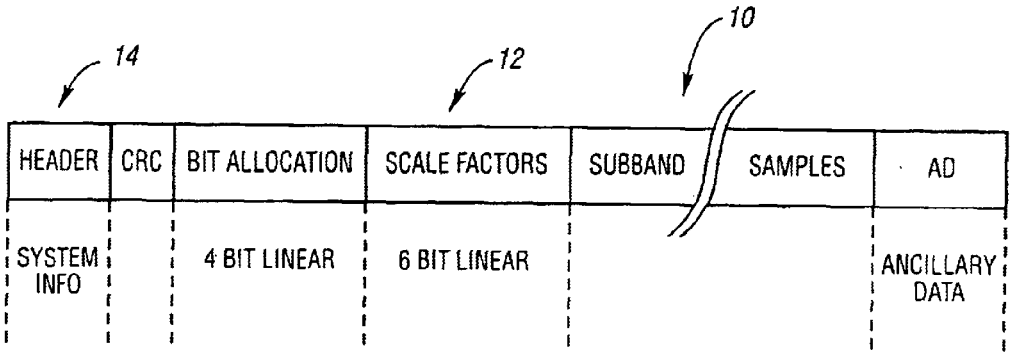
FIG. 1 is an exemplary encoding format for an audio frame according to prior art perceptually encoded audio systems.

Referring now to FIGS. 1–8, the preferred embodiment of the present invention will now be described. FIG. 1 depicts an exemplary encoding format for an audio frame according to prior art perceptually encoded audio systems, such as the various layers of the Motion Pictures Expert Group (MPEG), Musicam, or others. Examples of such systems are described in detail in a paper by K. Brandenburg et al. entitled "ISO-MPEG-1 Audio: A Generic Standard For Coding High-Quality Digital Audio", Audio Engineering Society, 92nd Convention, Vienna, Austria, March 1992, which is hereby incorporated by reference.

In that regard, it should be noted that the present invention can be applied to subband data encoded as either time versus amplitude (low bit resolution audio bands as in MPEG audio layers 1 or 2, and Musicam) or as frequency elements representing frequency, phase and amplitude data (resulting from Fourier transforms or inverse modified discrete cosine spectral analysis as in MPEG audio layer 3, Dolby AC3 and similar means of spectral analysis). It should further be noted that the present invention is suitable for use with any system using mono, stereo or multichannel sound including Dolby AC3, 5.1 and 7.1 channel systems.

As seen in FIG. 1, such perceptually encoded digital audio includes multiple frequency subband data samples (10), as well as 6 bit dynamic scale factors (12) (per subband) representing an available dynamic range of approximately 120 decibels (dB) given a resolution of 2 dB per scale factor. The bandwidth of each subband is ⅓ octave. Such perceptually encoded digital audio still further includes a header (14) having information pertaining to sync words and other system information such as data formats, audio frame sample rate, channels, etc.

To greatly increase the available dynamic range and/or the resolution thereof, one or more bits may be added to the dynamic scale factors (12). For example, by using 8 bit dynamic scale factors, the dynamic range is doubled to 256 dB and given an improved 1 dB per scale factor resolution. Alternatively, such 8 bit dynamic scale factors, with a given resolution of 0.5 dB per scale factor, will provide a dynamic range of 128 dB. In either case, the accuracy of storage is increased or maintained well beyond what is needed for dynamic range, while the side-effects of low resolution dynamic scaling are reduced.

Figure 2:
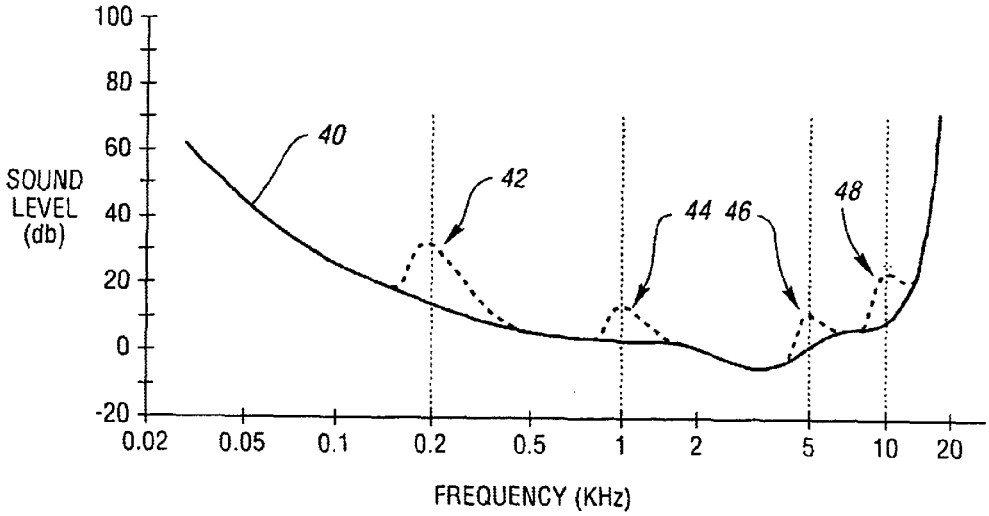
FIG. 2 is a psychoacoustic model of a human ear including exemplary masking effects for use with the present invention.

As previously discussed, perceptually encoded audio systems eliminate portions of the audio that might not be perceived by an end user. This is accomplished using well known psychoacoustic modeling of the human ear. Referring now to FIG. 2, such a psychoacoustic model including exemplary masking effects is shown. As seen therein, at a given frequency (in kHz), sound levels (in dB) below the base line curve (40) are inaudible. Using this information, prior art perceptually encoded audio systems eliminate data samples in those frequency subbands where the sound level is likely inaudible.

As also seen therein, short band noise centered at various frequencies (42, 44, 46, 48) modifies the base line curve (40) to create what are known as masking effects. That is, such noise (42, 44, 46, 48) raises the level of sound required around such frequencies before that sound will be audible to the human ear. Using this information, prior art perceptually encoded audio systems further eliminate data samples in those frequency subbands where the sound level is likely inaudible due to such masking effects.

Alternatively, using a loss-less component audio encoding scheme, such masked audio may be retained. Once again, such a loss-less component audio encoding scheme is described in detail in U.S. patent application Ser. No. 08/771,790 entitled "Method, System And Product For Lossless Encoding Of Digital Audio Data", which was filed on the same date and assigned to the same assignee as the present application, and has been incorporated herein by reference.

In either case, if no information is present to be encoded into a subband, the subband does not need to be transmitted. Moreover, if the subband data is well below the level of audibility (not including masking effects), as shown by base line curve (40) of FIG. 2, the particular subband need not be encoded.

As previously stated, the present invention provides a graphic interface for editing encoded audio data, preferably in the perceptually encoded data domain. The present invention is designed to display the encoded data in many modes, either individually or simultaneously.

Figure 3A:
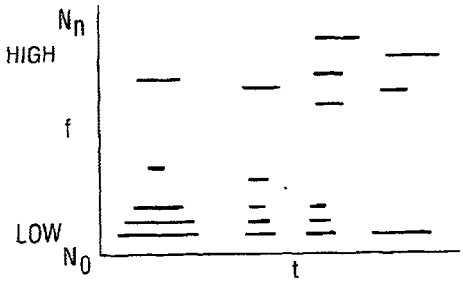
FIGS. 3*a* and 3*b* are exemplary spectral graphs generated according to the present invention.
Figure 3B:
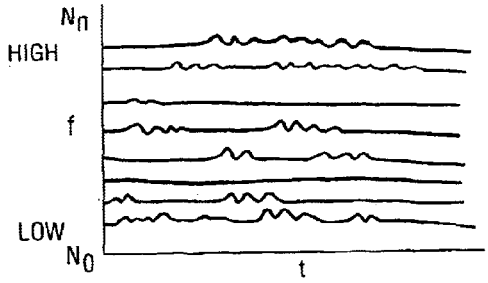

In that regard, referring now to FIGS. 3*a* and 3*b*, exemplary spectral versus time displays of the contents of encoded audio data generated according to the present invention are shown. More particularly, FIG. 3*a* represents each of the plurality of frequency subbands of an encoded audio signal over time. In that regard, the presence or absence of a component of the encoded audio signal in a particular subband may be represented by the presence or absence of a trace for that subband. In this example, the amplitude of a subband component may be represented by the relative brightness of the trace.

Similarly, FIG. 3*b* also represents each of the plurality of frequency subbands of an encoded audio signal over time, but here as a continuous trace. In this example, the amplitude of a subband component may be represented by the height of the trace. It should be noted that the relative features of the spectral displays of FIGS. 3*a* and 3*b* could also be combined.

Figure 4A:
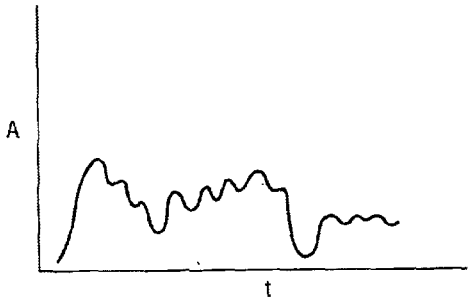
FIGS. 4*a* and 4*b* are exemplary amplitude graphs generated according to the present invention.
Figure 4B:
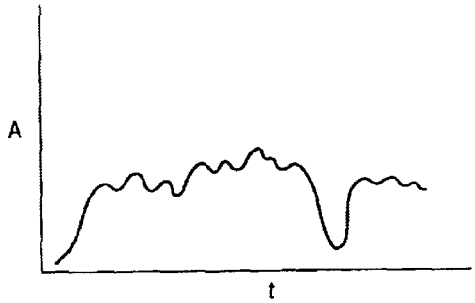
Figure 4C:
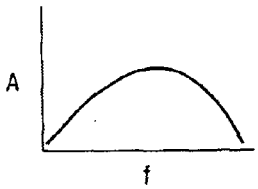
FIG. 4*c* is another psychoacoustic model for use with the present invention.

Referring next to FIGS. 4*a* and 4*b*, exemplary signal amplitude versus time displays of the contents of encoded audio data generated according to the present invention are shown. In that regard, the signal amplitudes depicted therein over time are a combination of the scale factors of each frequency subband of an encoded audio signal.

More particularly, FIG. 4*a* represents a non-perceptually contoured version of such amplitude over time, while FIG. 4*b* represents a perceptually contoured version of such amplitude over time. That is, using the well known psychoacoustic model of FIG. 4*c*, the signal depicted in FIG. 4*a* may be balanced according to the amplitude sensitivities of the human ear to produce the signal depicted in FIG. 4*b*.

Figure 5:
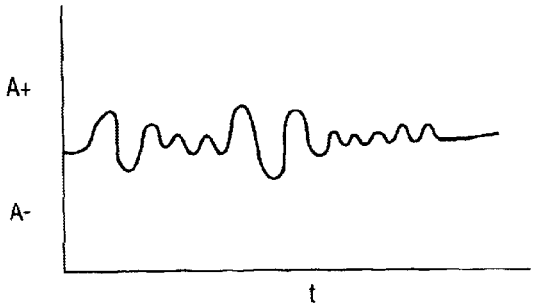
FIG. 5 is an exemplary waveform generated according to the present invention.

Referring next to FIG. 5, an exemplary waveform display of the contents of encoded audio data generated according to the present invention is shown. In that regard, the display is a standard version of a waveform such as might be produced by a conventional waveform editor illustrating signal amplitude over time, and represents a recombined version of the encoded audio data.

Figure 6:
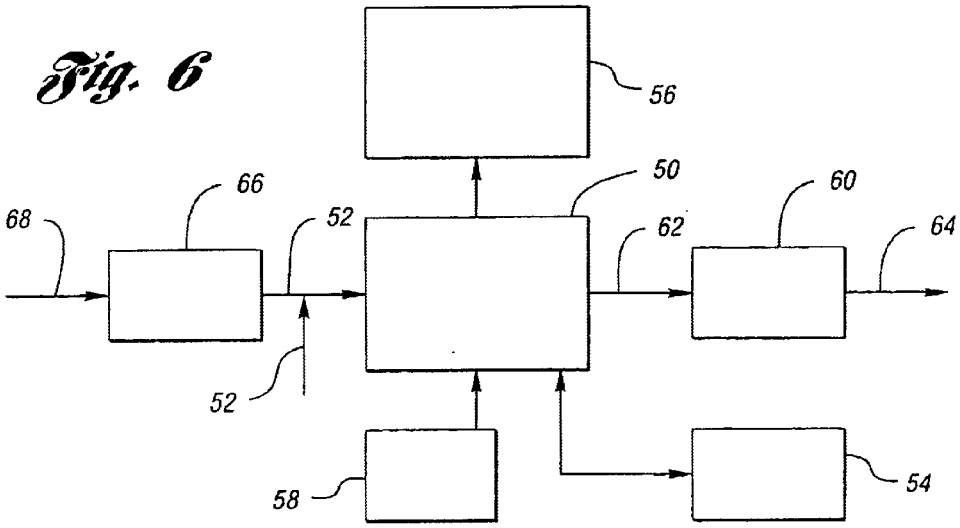
FIG. 6 is a simplified block diagram of the system of the present invention.
Figure 7:
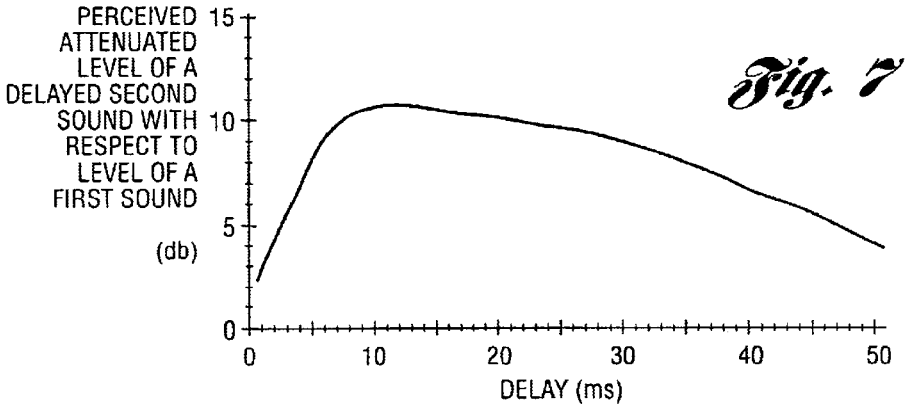
FIG. 7 is a Haas fusion zone curve for use with the present invention.

Referring now to FIG. 6, a simplified block diagram of the graphic interface system of the present invention is shown.

As seen therein, the system preferably comprises an appropriately programmed computer processing unit (CPU) (50) for Digital Signal Processing (DSP). CPU (50) acts as a receiver for receiving an encoded audio signal (52) (which may be a stored sound file/asset) having a plurality of frequency subbands associated therewith. While described herein as preferably perceptually encoded, as previously stated, encoded audio signal (52) may also be a component audio signal or sound file/asset. As will be described in greater detail below, once programmed, CPU (50) provides control logic for performing various functions of the present invention. In that regard, CPU (50) is provided in communication with a memory (54) for use in performing such functions.

The graphic interface system of the present invention still further comprises a display unit (56) in communication with CPU (50) for displaying the various spectral graphs, amplitude graphs and waveforms described above, as well as other items that will be described below in conjunction with the control logic of CPU (50). In that regard, as previously mentioned, display unit (56) is capable of displaying such graphs and waveforms either individually or separately, as desired by a user.

The graphic interface system of the present invention still further comprises an input device (58) in communication with CPU (50). In that regard, input device (58) may be a keyboard, mouse, any other known input device, or any combination thereof, and is provided for user control of the editing process by entering various selections associated with the control logic operations performed by CPU (50), such as edit points, as will be described below.

The graphic interface system also comprises a decoder (60) for decoding an edited encoded audio signal (62) for playback to a user as an audible signal (64) for auditioning purposes, which will be described in greater detail below. Still further, the graphic interface system may also comprise a translator (66) for converting an audio signal (68) of any other conventional format to encoded audio signal (52) for receipt by CPU (50). In such a fashion, original material having any conventional or generic format may be edited using the present invention.

The system of the present invention is thus provided with interfaces to pass either decoded audio data to the user or encoded audio to a perceptual audio decoding system, such as MPEG layers 1, 2 or 3. Translator (66) also provides a perceptual encoder/decoder to import or convert between audio data formats, especially the various MPEG layers. Such audio data conversion tools allow the graphic interface system of the present invention to go between any audio data formats, including audio effects and harmonic enhancement processing. In that regard, automatic decoding and recognition and system adjustment of the audio data format being "opened" are provided, by means of trajectory analysis or any other method or methods.

Still referring to FIG. 6, the control logic of CPU (50) is operative to perform a variety of functions. In that regard, control logic is operative to generate the spectral graphs, amplitude graphs, and waveforms previously described, and to mark at least one selectable edit point of the encoded audio signal. In that regard, the at least one edit point may be an amplitude of a frequency subband at a selected time, a combined amplitude of the frequency subbands at a selected time, a combined perceptual amplitude of the plurality of frequency subbands at a selected time, or a waveform amplitude at a selected time, which are displayed by display unit (56).

The control logic of CPU (50) also includes recognition functions based on user selected or imported sound samples or phonetic data. Such recognition functions are operative to automatically identify specific sounds, and to automatically edit or process such elements if desired. Control logic is also operative to provide visual transcriptions describing the sounds marked for editing. In conjunction with input device (58), control logic is also operative to accept or modify the automatically identified edit points of the data.

Also in conjunction with input device (58), the control logic of CPU (50) is still further operative to enable complete automatic editing of known data edit points according either to an externally supplied "script" or text file or, in an autonomous mode. In that regard, such recognition systems and automatic marking of waveforms for editing, especially for voice editing are disclosed in U.S. patent application Ser. No. 08/584,649 entitled "A System And Method For Automatically Generating New Voice Files Corresponding To New Text From A Script", filed Jan. 9, 1996 and assigned to the assignee of present application, which is hereby incorporated by reference.

In conjunction with input device (58), the control logic of CPU (50) is still further operative to permit precision changes to the data files such as increase or reduction of subband levels, or cut and paste of single or multiple ranges of subband signals with complete overlap abilities such as pasting the sound of an "s" on top of an "ah" sound. As is readily apparent to those of ordinary skill in the art, the graphic interface system of the present invention could also be adapted to work with Edit Decision Lists (EDLs) from conventional or other types of video and audio editing equipment.

Still further, in conjunction with decoder (60), the control logic of CPU (50) is also operative to test audition concatenated audio files or data segments edited/created from small or large lists of elements. In that regard, the elements that are about to be edited may be tested in concatenation and auditioned before committing such elements to definite edit points or data files. That is, the graphic interface system of the present invention provides the ability to operate in destructive (making changes to source data files) and non-destructive (only making changes to a file when processed either at playback time or upon regeneration to a new file) edit modes.

In conjunction with display unit (56), the control logic of CPU (50) is also operative to move a sound file/waveform, such as a voice print, past a fixed visual reference point, rather than having to move a cursor across a fixed screen. In such a fashion, a user could view progression of the audio signal over time. When used in conjunction with decoder (60), a user could hear the signal simultaneously.

The control logic of CPU (50) also includes a magnifier function operative to quickly switch between many different "zoom" levels of magnification in any editing mode, such as spectral, amplitude, or waveform displays. Still further, edits performed in any of the above-mentioned views will be displayed in the other views of the same data. As those of ordinary skill in the art will recognize, the graphic interface system of the present invention could also be adapted for use with any or all editing controls as used in any other conventional audio editing system.

It should be noted that in MPEG layer 1 or a higher resolution encoded audio format, such as the previously described component audio, editing is relatively uncomplicated. However, in MPEG layer 2 or layer 3, where the data is granualized in sub-frames and/or different window sizes, editing is more complex. In that regard, before making an edit point, marks must be recalculated, a decision must be made whether windowing functions must be changed, and the data must be repacked.

As a result, as also shown in FIG. 6, the control logic of CPU (50) is further operative to perform the well known data formatting and bit allocating functions associated with known perceptually encoded audio systems such as MPEG. In that regard, for such perceptually encoded audio systems, the control logic of CPU (50) would also calculate in appropriate masking effects, as previously described with reference to FIG. 2. In that same regard, the control logic is further operative to calculate well known temporal masking or pre-echo effects illustrated in the Haas fusion zone curve of FIG. 7.

Figure 8:
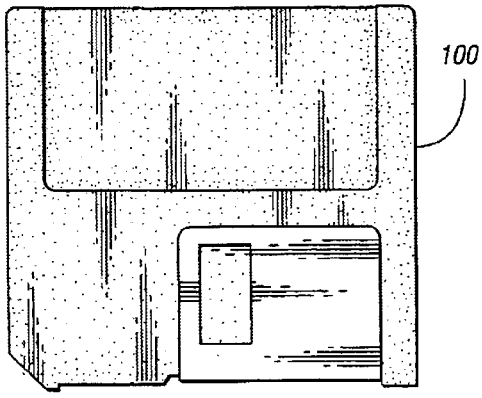
FIG. 8 is an exemplary storage medium for use with the product of the present invention.

Referring finally to FIG. 8, an exemplary storage medium for the product of the present invention is shown. In that regard, storage medium (100) is depicted as a conventional floppy disk, although any other type of storage medium may also be used. Storage medium (100) is designed for use with a receiver for receiving an encoded audio signal having a plurality of frequency subbands, a display unit and an input device.

In that regard, storage medium (100) has recorded thereon computer readable programmed instructions for performing various functions of the present invention. More particularly, storage medium (100) includes instructions operative to generate a spectral graph of the encoded audio signal, the spectral graph including an amplitude of each frequency subband as a function of time, and to mark at least one selectable edit point of the encoded audio signal, wherein the a display unit is provided for displaying the spectral graph including the at least one edit point marked, and the input device is provided for selecting the at least one edit point. The at least one edit point is preferably an amplitude of a frequency subband at a selected time.

The instructions may be further operative to generate an amplitude graph of the encoded audio signal, the amplitude graph including a combined amplitude of the plurality of frequency subbands as a function of time. In this embodiment, the at least one edit point is a combined amplitude of the frequency subbands at a selected time. Still further the instructions may also be operative balance the amplitude graph according to a psychoacoustic model, and generate a perceptual amplitude graph of the encoded audio signal, the perceptual amplitude graph including a combined perceptual amplitude of the plurality of frequency subbands as a function of time. In this embodiment, the at least one edit point is a combined perceptual amplitude of the plurality of frequency subbands at a selected time.

In such a fashion, the present invention facilitates production of concatenated, high quality audio for interactive services and multimedia in general. The present invention allows precision editing of otherwise un-editable data concatenation of voice recordings (and other sounds) to simulate a person speaking (in high fidelity) such as in response to computer commands or a user action. The present invention can also be used as part of an automatic dialog replacement (ADR) system. The present invention thus enables interactive audio of extremely high quality with extreme data compression on any interactive service, CD-ROM, computer, multimedia system, or numerous other applications such as entertainment, including audio/video post-production.

It should still further be noted that the present invention can be used in conjunction with the inventions disclosed in U.S. patent application Ser. No. 08/771,790 entitled "Method, System And Product For Lossless Encoding Of Digital Audio Data"; Ser. No. 08/771,462 entitled "Method, System And Product For Modifying The Dynamic Range Of Encoded Audio Signals"; Ser. No. 08/771,792 entitled "Method, System And Product For Modifying Transmission And Playback Of Encoded Audio Data"; Ser. No. 08/771,512 entitled "Method, System And Product For Harmonic Enhancement Of Encoded Audio Signals"; Ser. No. 08/769,911 entitled "Method, System And Product For Multiband Compression Of Encoded Audio Signals"; Ser. No. 08/777,724 entitled "Method, System And Product For Mixing Of Encoded Audio Signals"; Ser. No. 08/769,732 entitled "Method, System And Product For Using Encoded Audio Signals In A Speech Recognition System"; Ser. No. 08/772,591 entitled "Method, System And Product For Synthesizing Sound Using Encoded Audio Signals"; and Ser. No. 08/769,731 entitled "Method, System And Product For Concatenation Of Sound And Voice Files Using Encoded Audio Data", all of which were filed on the same date and assigned to the same assignee as the present application, and which are hereby incorporated by reference.

In that regard, in conjunction with the methods, systems and products disclosed therein, the control logic of CPU (50), together with the remaining elements of the graphic interface system of the present invention, or the computer readable programmed instructions recorded on storage medium (100) are operative to perform various other functions. Such functions include generating an edited encoded audio signal based on mixing using the encoded audio signal, generating an edited encoded audio signal based on harmonic enhancement of the encoded audio signal, generating a synthetic encoded audio signal using the encoded audio signal, and generating an edited encoded audio signal based on concatenation using the encoded audio signal.

As is readily apparent from the foregoing description, then, the present invention provides a graphic interface system and product for editing encoded audio signals, particularly perceptually encoded audio signals. The present invention allows precision editing of otherwise un-editable data to facilitate direct creation of extremely data compressed and high quality audio. Indeed, by editing directly to encoded audio formats such as perceptually encoded or component audio, edits are covered easily by means of the final decoding methods of the audio.

It is to be understood that the present invention has been described above in an illustrative manner and that the terminology which has been used is intended to be in the nature of words of description rather than of limitation. As previously stated, many modifications and variations of the present invention are possible in light of the above teachings. Therefore, it is also to be understood that, within the scope of the following claims, the invention may be practiced otherwise than as specifically described herein.

What is claimed is:

1. A graphic interface system for direct editing of a subband encoded audio signal having a plurality of frequency subbands, the system comprising:

receiver for receiving the subband encoded audio signal;

control logic operative to generate a spectral graph of the subband encoded audio signal, the spectral graph including an amplitude of each of the plurality of frequency subbands of the subband encoded audio signal as a function of time, and to mark at least one selectable edit point of the subband encoded audio signal, wherein the at least one selectable edit point includes an amplitude of any one of the plurality of frequency subbands of the subband encoded audio signal at a selected time;

a display unit for displaying the spectral graph and the at least one selectable edit point; and an input device for selecting the at least one selectable edit point.

2. The system of claim 1 wherein the encoded audio signal comprises a perceptually encoded audio signal.

3. The system of claim 1 wherein the encoded audio signal comprises a component audio signal.

4. The system of claim 1 wherein the control logic is further operative to generate an amplitude graph of the encoded audio signal, the amplitude graph including a combined amplitude of the plurality of frequency subbands as a function of time, and wherein the at least one edit point includes a combined amplitude of the frequency subbands at a selected time.

5. The system of claim 4 wherein the control logic is further operative to generate a waveform representation of the encoded audio signal, the waveform including a waveform amplitude as a function of time, and wherein the at least one edit point includes a waveform amplitude at a selected time.

6. The system of claim 5 further comprising a magnifier for magnifying the display of the spectral graph, the amplitude graph, and the waveform.

7. The system of claim 6 wherein the control logic is further operative to recognize a plurality of sounds represented by the encoded audio signal, and to automatically identify at least one edit point based on such recognition.

8. The system of claim 7 further comprising a memory in communication with the control logic, wherein the control logic is further operative to automatically edit the encoded audio signal using the at least one edit point marked according to a stored text file.

9. The system of claim 7 wherein the control logic is further operative to generate a transcript describing a recognized sound having an identified edit point, and wherein the display unit is further for displaying the transcript.

10. The system of claim 7 wherein the control logic is further operative to change an audio level associated with a frequency subband to a selected value according to an audio level input signal, and wherein the input device is further for generating the audio level input signal.

11. The system of claim 7 further comprising a translator for receiving a non-encoded audio signal and generating the encoded audio signal for receipt by the receiver.

12. The system of claim 7 further comprising:

a memory for storing an edited encoded audio signal; and a decoder for decoding the edited encoded audio signal for playback.

13. The system of claim 12 wherein the edited encoded audio signal is created without destruction of the encoded audio signal.

14. A graphic interface product for direct editing of a subband encoded audio signal having a plurality of frequency subbands, the product for use with a receiver for receiving the subband encoded audio signal, a display unit and an input device, the product comprising:

a storage medium;

computor readable instructions recorded on the storage medium, the instructions operative to generate a spectral graph of the subband encoded audio signal received by the receiver, the spectral graph including an amplitude of each one of the plurality of frequency subbands of the subband encoded audio signal as a function of time, and to mark at least one selectable edit point of the subband encoded audio signal, wherein the at least one selectable edit point includes an amplitude of any one of the frequency subbands of the subband encoded audio signal at a selected time, the display unit is provided for displaying the spectral graph and the at least one selectable edit point, and the input device is provided for selecting the at least one selectable edit point.

15. The product of claim 14 wherein the instructions are further operative to generate an amplitude graph of the encoded audio signal, the amplitude graph including a combined amplitude of the plurality of frequency subbands as a function of time, and wherein the at least one edit point includes a combined amplitude of the frequency subbands at a selected time.

* * * * *